US005890843A

United States Patent [19]

Bastick et al.

[11] Patent Number: 5,890,843

[45] Date of Patent: Apr. 6, 1999

[54] STRIP FOR USE IN STABILIZED EARTH STRUCTURES AND METHOD OF MAKING SAME

[75] Inventors: Michel Jack Fernand Bastick, Puteaux; Jean-Marc Jailloux, Sannois, both of France

[73] Assignee: Societe Civile Des Brevets Henri Vidal

[21] Appl. No.: 635,925

[22] PCT Filed: Oct. 19, 1994

[86] PCT No.: PCT/GB94/02286

§ 371 Date: Jun. 28, 1996

§ 102(e) Date: Jun. 28, 1996

[87] PCT Pub. No.: WO95/11351

PCT Pub. Date: Apr. 27, 1995

[30] Foreign Application Priority Data

| | | | |
|---|---|---|---|
| Oct. 22, 1993 | [GB] | United Kingdom | 9321792 |
| Aug. 23, 1994 | [GB] | United Kingdom | 9417134 |

[51] Int. Cl.[6] ..... E02D 17/18; E02D 17/20

[52] U.S. Cl. ..... 405/259.1; 405/262

[58] Field of Search ..... 405/258, 284, 405/259.1, 262, 272

[56] References Cited

U.S. PATENT DOCUMENTS

| | | | |
|---|---|---|---|
| 3,999,392 | 12/1976 | Fukushima et al. | 405/281 |
| 4,056,911 | 11/1977 | Tani | 52/740.3 |
| 4,116,010 | 9/1978 | Vidal | 405/262 |
| 4,530,622 | 7/1985 | Mercer | 405/258 |
| 4,834,584 | 5/1989 | Hilfiker | 405/262 |
| 4,834,585 | 5/1989 | Hasenwinkle et al. | 405/286 |
| 4,990,390 | 2/1991 | Kawasaki | 428/113 |
| 5,039,250 | 8/1991 | Janz | 405/258 X |

FOREIGN PATENT DOCUMENTS

| | | |
|---|---|---|
| 0211082 | 2/1987 | European Pat. Off. . |
| 2067064 | 8/1971 | France . |
| 2486987 | 1/1982 | France . |
| 2753224 | 6/1979 | Germany . |
| 3728255 | 3/1989 | Germany . |
| 107471 | 10/1953 | New Zealand . |
| 136689 | 8/1966 | New Zealand . |
| 146171 | 7/1968 | New Zealand . |
| 187928 | 9/1982 | New Zealand . |
| 189521 | 5/1983 | New Zealand . |
| 219278 | 2/1987 | New Zealand . |
| 211847 | 5/1989 | New Zealand . |
| 1069361 | 5/1967 | United Kingdom . |
| 1563317 | 3/1980 | United Kingdom . |
| 2035191 | 6/1980 | United Kingdom . |
| WO9003885 | 4/1990 | WIPO . |

*Primary Examiner*—Tamara L. Graysay
*Assistant Examiner*—Tara L. Mayo
*Attorney, Agent, or Firm*—Banner & Witcoff, Ltd.

[57] ABSTRACT

A strip for use in a stabilized earth structure has a tensile portion in the form of an elongate core which supports lateral friction wings and optional ribs. The elongate core may be steel or a polymer material and the wings are fabricated from a plastic material. Alternatively, the strip may be made from a single material (e.g., plastic) with a thickened region defining the core and thinner regions providing the friction wings.

35 Claims, 8 Drawing Sheets

STRIP FOR USE IN STABILIZED EARTH STRUCTURES AND METHOD OF MAKING SAME

CROSS REFERENCES TO RELATED APPLICATIONS

This application corresponds to PCT International Application No. PCT/GB94/02286 filed Oct. 19, 1994 and priority applications filed in the United Kingdom as Application No. 9321792.5 filed Oct. 22, 1993 and Application No. 9417134.5 filed Aug. 23, 1994 upon which a claim for priority is made.

BACKGROUND OF THE INVENTION

This invention relates to a stabilising strip for use in stabilised earth structures.

A stabilised earth structure is one in which stabilising elements, such as elongate strips, are combined with backfill, such as earth, in order to form a composite material. The strips extend rearwardly from a facing into the backfill and are horizontally and vertically spaced from each other. Such structures are commonly employed to provide retaining walls and abutments for bridges. They are known from, for example, GB-A-1 069 361 incorporated herewith by reference.

In the vast majority of cases, the stabilising elements are provided in the form of strips having a length of between about 3 and 10 m, although shorter strips and occasionally longer ones of up to about 20 m may be used. The width of the strips is generally between 4 and 6 cm although it is known to use strips of up to 10 or 25 cm in width. Their thickness ranges from about 1 mm to a few centimeters and is generally in the range of 1 to 6 mm.

The purpose of the stabilising strips is to transmit forces within the earth mass and to distribute stresses. In particular, it is firstly necessary to transmit forces between a strip and the backfill in which it is placed and therefore the strip must have a sufficiently large surface area to develop through friction the required shear resistance per unit length. In order to increase the shear resistance, the width of the strip must be increased. The surfaces of the strip may also be provided with laterally extending ribs to increase the frictional interaction with the earth, as is known from GB-A-1 563 317 incorporated herewith by reference.

Secondly, the strips must be capable of transmitting forces along their length and therefore it is necessary that they have a high tensile strength.

As well as these two main functions which are fundamental to the basic operation of the stabilised earth structure, various other characteristics are also highly desirable. A reinforcing strip should be able to flex in a vertical plane in order to accommodate soil deformation, such as settlement or shrinkage, without being damaged; the strip should have a high breaking strain, to give good elongation before it breaks; and the strip should also be durable, having a slow and predictable rate of degradation with time, even in an aggressive backfill environment. When steel strips are used, these requirements generally make it necessary to use strips of at least 4 or 5 mm in thickness in order to provide the necessary strength, bearing in mind the effects of degradation over time. When this thickness is combined with the width of the strip which is required in order to provide sufficient frictional interaction with the earth, the result is a technical over-design in terms of the tensile capacity of the strip, particularly for low structures and the upper part of higher structures. It will be appreciated therefore that strips having a high weight per unit length are employed, such that the strips are heavy to transport and install, as well as expensive.

SUMMARY OF THE INVENTION

The invention provides a strip for use in stabilised earth structures, comprising a longitudinally extending tensile portion for resisting tensile force, and a lateral portion which projects laterally of the tensile portion for frictional engagement with earth.

Thus, the tensile portion can be designed or selected in accordance with the required tensile resistance of the strip, whilst the lateral portion can be separately designed or selected in accordance with the required frictional engagement forces to be mobilised. Therefore the strip may be designed to optimise its performance in both of these respects whilst providing a more economical use of the material or materials from which the strip is made.

It will be appreciated that the tensile portion will generally extend across only part of the width of the strip, for example less than half or less than one third. Preferably the tensile portion extends across about one quarter of the width of the strip, and possibly one tenth. The lateral portion will then project laterally across the remaining part of the width. Thus, in general, the extent of lateral projection of the lateral portion will be substantially greater than the thickness of the strip.

In practice, the surfaces of the strip immediately above and below the tensile portion will be in contact with the earth above and below and will thus make a greater or lesser contribution to the frictional engagement with the earth, depending on the size and profile of these surfaces. This will be in addition to the frictional capacity of the lateral portion. Moreover, the lateral portion may make a contribution to the tensile resistance of the strip.

However, as the function of transmitting the stresses within the structure along the length of the strip is primarily carried out by the tensile portion of the strip, only this portion need be strong enough to carry the tensile loads. Therefore, there is no need for the lateral portion to have a high tensile strength and so in order to save materials it is preferred that the tensile portion has a higher total tensile strength than the lateral portion.

In a typical example, a 6 m length strip may be subject to a maximum tensile load of 15 to 20 kN. Assuming a maximum tensile force of 16 kN and a cross-sectional area of the tensile portion of 80 $mm^2$, there will be a tensile stress of 200$MN/m^2$. The maximum shear stress resulting from the transmission of frictional forces from the lateral portion to the tensile portion may typically be about 1$MN/m^2$. Hence, although the two stresses are not directly comparable since one is a tensile stress and the other one a shear stress, the stress which will have to be sustained by the tensile portion is about two orders of magnitude larger than the stress that will have to be sustained by the lateral portion.

This explains why considerable savings may be obtained by separating the two functions of tensional and frictional capacity, for example by using two different materials, or two different thicknesses, or a combination of both, or the same materials and thicknesses and with the lateral portion including perforations.

The tensile portion and the lateral portion may thus be of the same thickness, if the tensile portion is made from a stronger material than the lateral portion, or if the portions are of the same material but the lateral portion includes perforations.

Preferably, however, the tensile portion is thicker than the lateral portion. The minimum thickness to provide the necessary tensile strength is only required in the tensile portion and therefore the lateral portion may be made much thinner because the stresses acting upon it are comparatively low. In fact, even if a localised area, for example a few square centimeters, of the lateral portion were to disappear through degradation, this would not significantly impair the stability of the structure. Thus the cross-sectional shape of the lateral portion is in theory ideally a wide and thin section, but for practical purposes may be other shapes where the ratio of its perimeter/cross-sectional area is large. Preferred shapes are a thin rectangle or two or more thin rectangles.

A thicker tensile portion is generally preferred, in order to provide a low ratio of its perimeter/cross-sectional area. This decreases the contact with the environment for any given cross-sectional area of the tensile portion. Consequently the section of the tensile portion is in theory ideally circular, but for practical purposes may be circular, oval, square, rectangular or other shapes where the perimeter/cross-sectional area ratio is small.

The preferred requirement that the tensile portion is thicker than the lateral portion will generally apply along the full length of the strip. However, it may be appropriate in certain circumstances to provide regions where the tensile portion is thinner than it is in the remainder of the strip, for example, at the end of the strip furthest from the facing where the tensile forces are lowest.

If different materials are used for the lateral portion and the tensile portion, they may have substantially different properties. For example the tensile portion could be formed of a strong material such as steel or polymer yarns or drawn bulk polymer and the lateral portion may be made of a material which may not be mechanically very resistant but is resistant to degradation such as some plastics materials like polyethylene or polypropylene. The use of plastics to provide the lateral portion is also advantageous because these materials are lightweight and easy to form with appropriate surface texture, perforations etc.

The tensile and lateral portions of the strip may be provided in different ways depending upon the profile chosen for the strip and the choice of materials. For example, the lateral portion may project laterally on one side only of the strip. Preferably however the tensile portion is a core from which lateral portions project laterally on both sides. Thus, the lateral portions may be in the form of friction wings extending on opposite sides of the core.

Alternatively, the tensile portion may comprise a plurality of cores interconnected by the lateral portion. For example, two cores may be provided. Thus, the tensile loading could be divided between the two cores and these cores may be connected together by the lateral portion, which may also have wings at the sides of the strip.

It is possible that the strip could be formed with a smooth outer surface and the frictional interengagement with the earth could then be provided simply by having a sufficiently large surface area for the lateral portion. However, it is preferred that the lateral portion be provided with a surface which has been adapted to resist longitudinal motion through the earth. Therefore, preferably, the lateral portion is provided with ribs and/or corrugations and/or perforations to improve the frictional interaction with the earth. Corrugations, ribs or a rough surface may be obtained by pressing the strip into hot or cold dies, or by gluing, pasting or welding to the strip a corrugated/ribbed/rough coating. The various means for improving frictional interaction may if desired be provided across the surfaces of the strip above and below the tensile portion, and not just on the lateral portion.

In general, the lateral portion will extend longitudinally of the strip, preferably continuously but if short breaks are provided at longitudinal intervals this may not significantly affect its performance. Any such breaks will normally be shorter than the remaining lengths of the lateral portion.

The tensile portion of the strip may typically have a cross-sectional area in the range from about 15–400 $mm^2$, for example about 100 $mm^2$. A tensile portion of circular cross-section may have a diameter of about 5–16 mm and more usually about 8–12 mm, whilst a tensile portion of rectangular cross-section may have a width of about 15–30 mm and a thickness of about 4–15 mm but more usually about 5–8 mm. The total strip width may be about 20–80 mm and more usually about 40–70 mm. The thickness of the lateral portion may be about 1–5 mm or 1–3 mm, plus 1–3 mm ribs if these are provided. The ratio of the tensile portion thickness/lateral portion thickness may typically be in the range 2–4. The above figures are merely examples and other dimensions may be desired or required in certain circumstances, for example with very short or very long strips. The figures given are also particularly applicable to substantially all steel strips or strips with a steel tension portion and a plastics lateral portion, although in practice they may also apply to other forms of strip, such as polymer/plastics strips.

The strips may be designed to be impermeable to water. However, in some circumstances it may be useful to provide a strip which permits entry of water thereto and longitudinal transport of water therealong. Because water can flow into such a strip and then along it, the strip may be used to drain the backfill within which it is located, reducing the pore water pressure. For example, water may be transported to the front of an earth structure and allowed to drain away. By removing water, the adherence between the strip and the backfill material is increased and so, for a given number or surface area of stabilising members, a lower quality, less well draining backfill material may be used. Thus, these strips may be employed in areas where the available backfill material is, for example, clay, without the need to incur the expense of transporting better quality backfill material from elsewhere. The drainage property of the strip also speeds up consolidation of the backfill.

The transport of water from the inside of a structure to the surface is also advantageous when the facing includes vegetation growth and conditions are dry, since water can be transferred to the vegetation.

Various methods may be used to secure the strip to the facing of a stabilised earth structure. The strip may have at one end an integral pad adapted to have formed therethrough an aperture suitable to receive fastening means, such as a vertical pin or bolt, to locate the strip in a stabilised earth structure, the thickness of the pad being greater than the thickness of the lateral portion. The pad may be thicker than the tensile portion or it may be more convenient for it to have the same thickness. In one example, the cross-sectional shape of the pad is rectangular, whereby the pad has a uniform thickness across its width. In another example, when viewed in cross-section, the pad has a thick central region and a thinner lateral region on each side thereof, both the central and the lateral regions being thicker than the lateral portion elsewhere in the strip. Typically, the pad is 40–100 mm in length. The pad may be formed by various means such as by hot forging, but preferably the strip is rolled to include thickened pads at longitudinal intervals, as is known from GB-A-2 177 140. The strip is then cut so that one of the pads is located at an end of the strip and can be formed with a vertical hole for receiving a pin for connection to the facing. In the case of the composite strips, the pad will normally be formed integrally with the tensile portion thereof.

In a stabilised earth structure the facing is designed to take the local loads exerted by the adjacent backfill. If the strips are widely spaced from each other, a stronger facing is required to resist backfill pressure; in other words, the required strength of the facing is directly dependent on the strip spacing. As discussed above in relation to known strips, there is a lower limit to the strip thickness to allow for degradation and there is a lower limit to the strip width to ensure adequate frictional interaction with the earth, with the result of a practical lower limit to the strength of the strip. In existing structures this has led, for reasons for economy, to a relatively small number of strong strips at wide spacings and to the requirement for a rather strong facing. Another advantage of the strip of the present invention is that the minimum strength of the strip can be decreased leading to a less strong and less expensive facing.

The present invention also extends to a stabilised earth structure comprising stabilising strips as set out herein. Such a structure can benefit both from economical strips and an economical facing.

There are two main classes of manufacturing methods by which strips according to the invention may be made. First, the strip may be made from a single type of material. Second, a plurality of materials may be combined.

In the first case, separate pieces of the same material may be glued, welded, or joined together by other means. Preferably, however, the strip is made from a single piece of material formed into an appropriate shape, for example by casting. A preferred method of making a stabilising strip comprises rolling a blank to form the strip.

The strip may be rolled in a single stage, or, alternatively, a first rolling stage may provide the general outline and then a further stage may add ribs, corrugations or perforations as appropriate. Thus, for example, the method may further comprise the step of cutting apertures in the lateral portion.

In the second case, the lateral portion could be attached to the tensile portion in a number of ways, such as by welding or by the use of clamps, bolts, adhesives, etc. However, it is particularly preferred that the tensile portion be surrounded by the material which forms the lateral portion. By encasing the tensile portion in this way it may be protected from corrosion by the material which also forms the lateral portion, as well as providing a strong connection between the portions.

In order to improve adherence between the lateral portion and the tensile portion, the tensile portion may be provided with ribs or the like.

The material forming the lateral portion may be moulded around the tensile portion or, alternatively, it may be provided in two separate parts which are brought together with the tensile portion sandwiched therebetween. The parts may be glued, hot welded (e.g. by a pair of press and weld cylinders), hypersonically or ultrasonically welded or attached by other appropriate means.

BRIEF DESCRIPTION OF THE DRAWINGS

Certain preferred embodiments of the invention will now be described, by way of example only, with reference to the accompanying schematic drawings.

DESCRIPTION OF THE PREFERRED EMBODIMENTS

Figure 1:
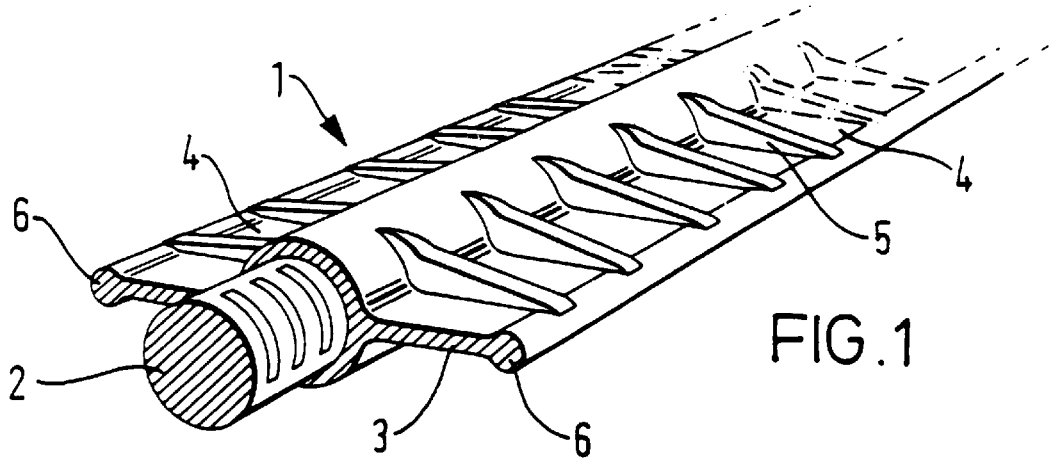
FIG. 1 is a perspective view of a first embodiment of the invention.

Turning first to FIG. 1 there is illustrated a strip 1 for use in a stabilised earth structure which has a tensile portion in the form of a steel core 2. This is surrounded by a casing 3 which has a pair of laterally projecting portions in the form of friction wings 4. At the tip of each wing 4 a thickened bead 6 is provided. In order to assist in the engagement of the friction wings with soil, the wings are provided with small vertically projecting ribs 5, provided alternately on the top and bottom faces of the strip (the bottom ribs not being shown).

The core 2 may be made out of a steel bar which may have a smooth surface, or be sanded, gritted or otherwise roughened or deformed to enhance adherence to the friction wings. Thus a deformed or high adherence reinforcing bar of the type normally used to reinforce concrete may be used, or a smooth reinforcing bar may be used. The core may alternatively be made of other materials such as stainless steel or aluminium alloys.

The casing 3 may be made of a polymer material such as polyethylene, polypropylene, PVC etc. This may be treated to resist UV light by the addition of carbon black and its strength may be increased by the addition of glass fibre. Other additives such as talc may be used to enhance durability or resistance to impact.

The diameter of the core 2 may be anything from a few millimeters to a few centimeters but is usually in the range 5–15 mm. In the example of FIG. 1, the diameter is 10 mm. The thickness of the friction wings 4 is 3 mm, the diameter of the beads 6 is 5 mm, and the height of the ribs 5 is 2 mm.

Figure 2:
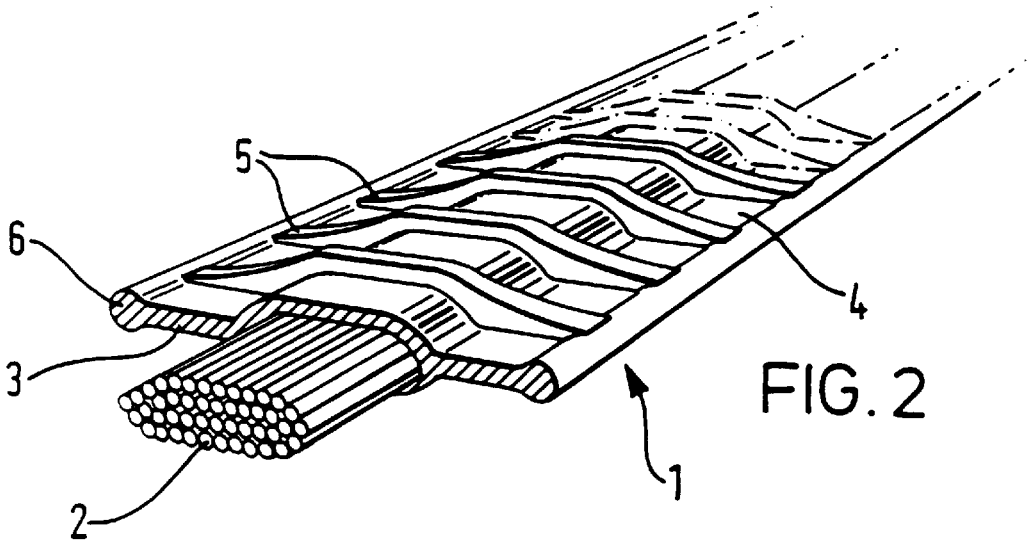
FIG. 2 is a perspective view of a second embodiment of the invention.

A similar structure may be employed when a core of polymer is used. Such a strip 1 is illustrated in FIG. 2. In this figure the core 2 is somewhat flatter in profile than that of FIG. 1 and therefore the casing 3 is shaped accordingly. It will be noted that in this embodiment the ribs 5 extend most of the way across the width of the strip 3 and therefore extend above and below the core 2 as well as on the friction wings 4. The core 2 may consist of a tension resistant polymer in its bulk form, in drawn members, or in jointed yarns.

Figure 3:
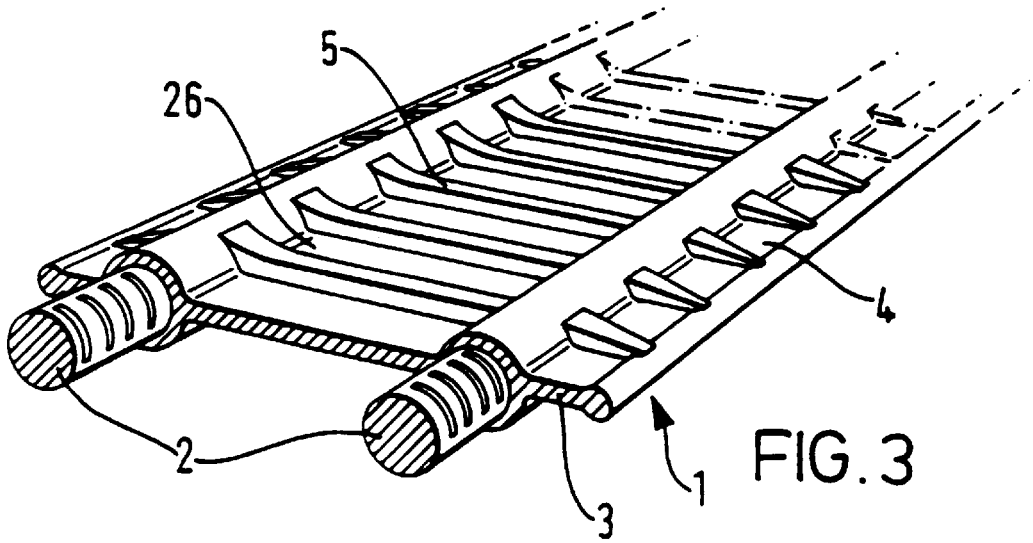
FIG. 3 is a perspective view of a third embodiment of the invention.

FIG. 3 illustrates a third type of strip 1, in which two steel cores 2 are provided, each formed from a reinforcing bar. These are laterally spaced and interconnected by the casing 3 which has two small friction wings 4 on opposite lateral sides of the strip and a larger central interconnecting part 26 between the two cores. Ribs 5 are provided on all three parts of the casing 3 although because of its larger size, larger ribs are formed on the central part 26.

Figure 4:
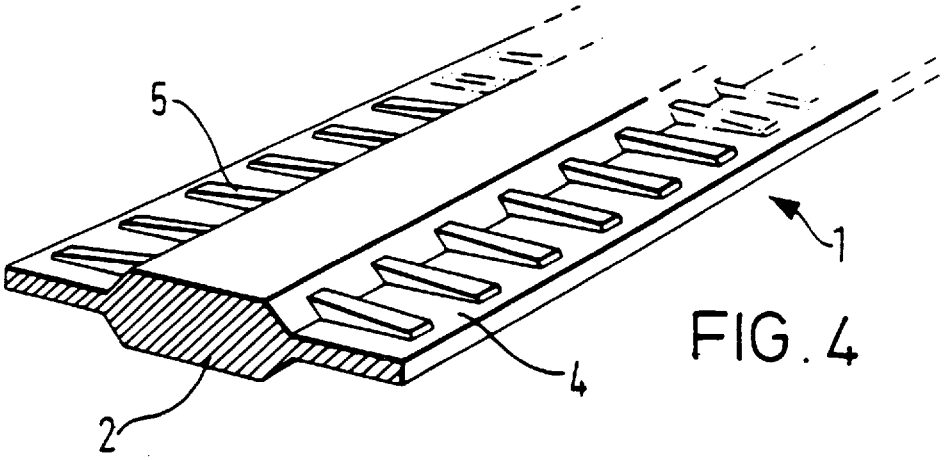
FIG. 4 is a perspective view of a fourth embodiment of the invention.
Figure 5:
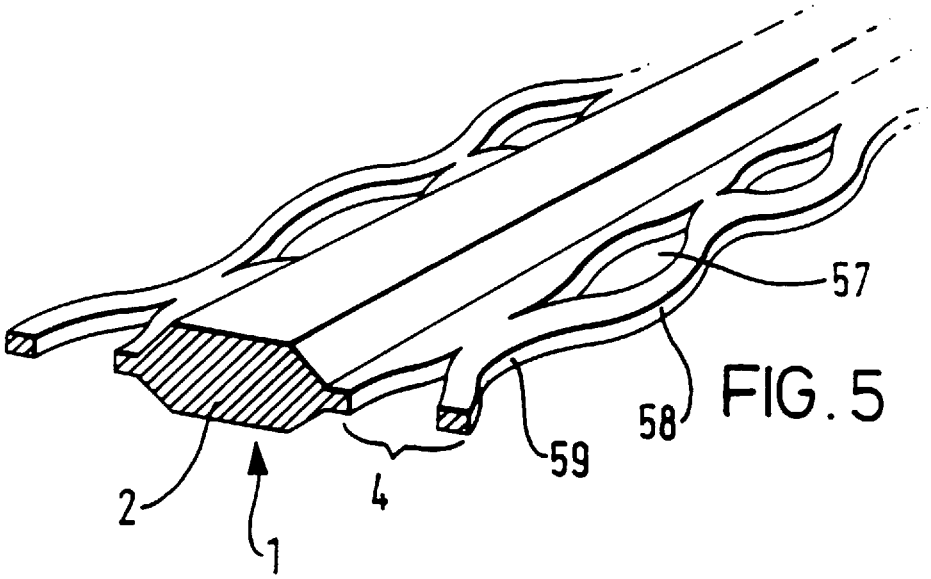
FIG. 5 is a perspective view of a fifth embodiment of the invention.
Figure 6:
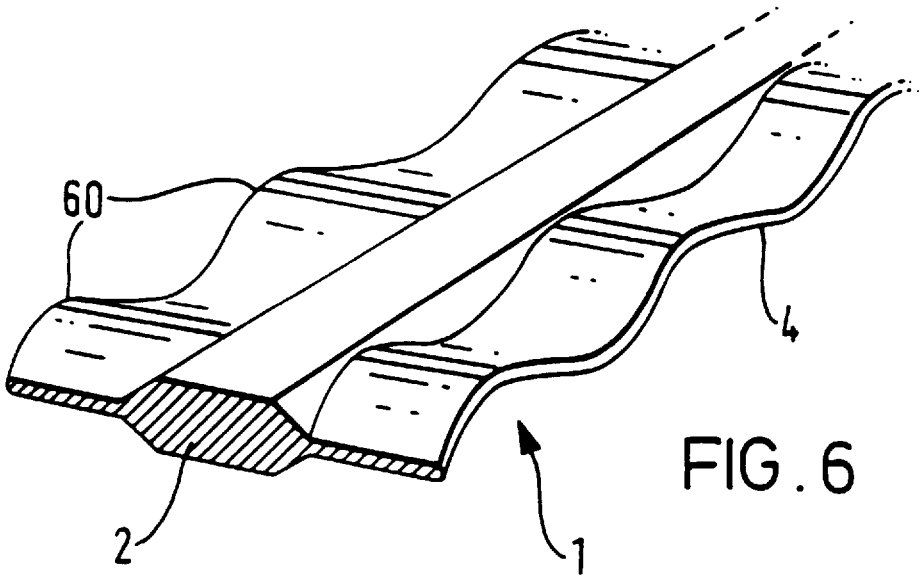
FIG. 6 is a perspective view of a sixth embodiment of the invention.

FIGS. 4 to 6 illustrate embodiments of the invention which are made from a single type of material. FIG. 4 illustrates a strip 1 which is the fourth embodiment of the invention. This has a thick core 2 which extends along the centre and has thinner laterally projecting portions on each side which form friction wings 4. Ribs 5 project at intervals from the wings.

FIGS. 5 and 6 illustrate the fifth and sixth embodiments of the invention respectively, which are similar to the fourth embodiment, except for the method in which the frictional engagement with the earth is increased. The embodiment of FIG. 5, rather than having ribs projecting from its friction wings 4, instead has perforations 57 for assisting frictional interaction with the earth. The perforations 57 are formed by cutting slots at intervals along the friction wings and opening the slots. Thus, the lateral edges of the wings have projections 58 and recesses 59 caused by this action. These further assist in engagement with the earth. In FIG. 6 the friction wings 4 have corrugations 60; in other words they are rippled up and down with a respect to the core 2.

Figures 12, 13:
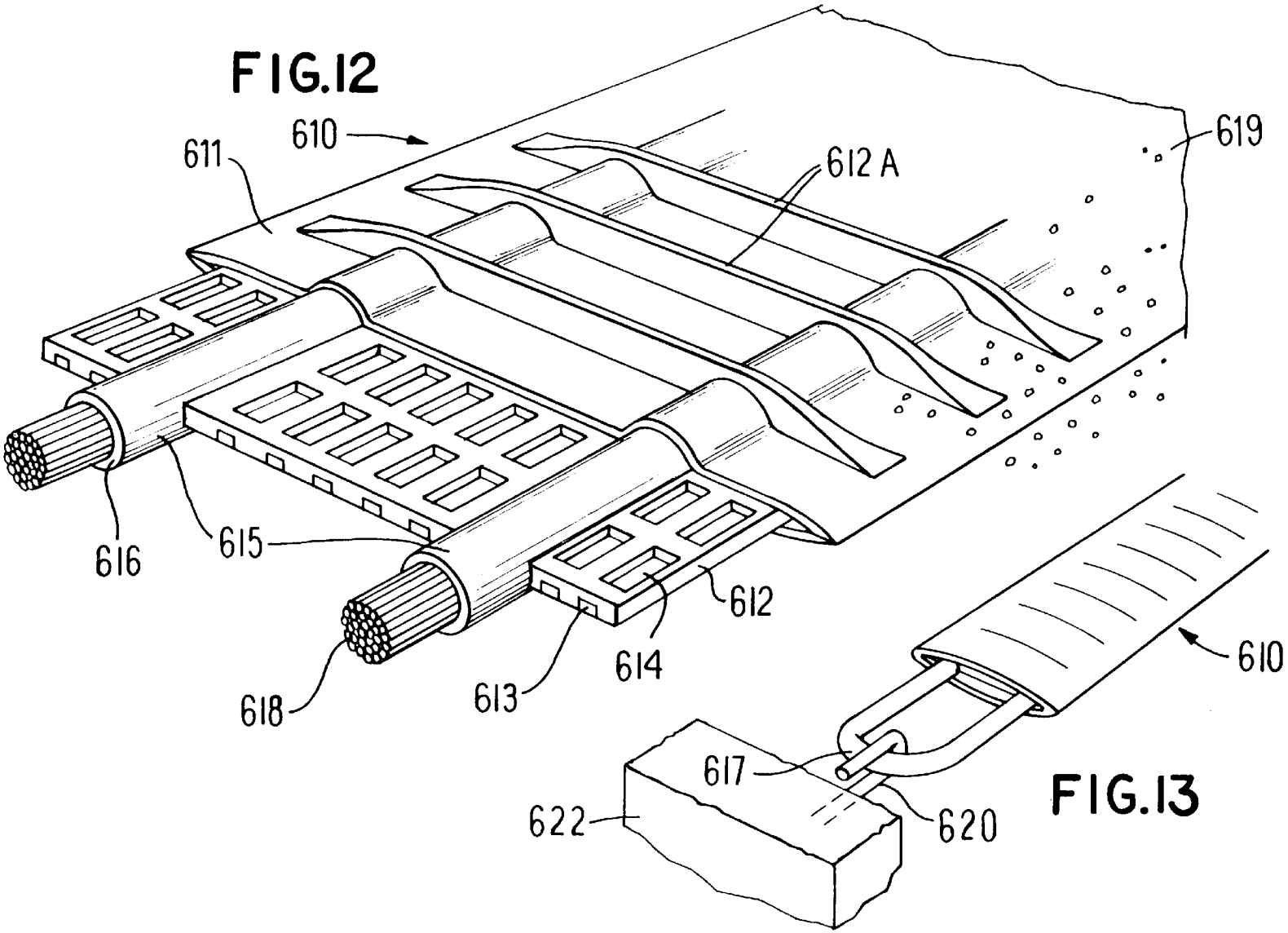
FIG. 12 is a perspective view of a seventh embodiment of the invention.
FIG. 13 is a schematic view of one end of the strip of FIG. 12.

A seventh embodiment 610 is shown in FIG. 12. This strip has an outer covering 611 of perforated PVC which surrounds a plastics water transmitting portion 612 and two cores 615. The outer covering 611 is provided with small perforations (not shown) to allow the ingress of water as will be explained below. It is further provided with moulded ribs 612A to improve the engagement of the strip with backfill material 619.

The water transmitting portion 612 is a wafer like member of plastics material which has channels 613 along its length in order to allow water to be transmitted along the strip. Communicating with the channels are openings 614 to enable water to flow into the channels. Thus, in use, water in the backfill material, which will be under pressure, will be forced through the perforations in the outer covering into the openings 614 and will then be able to flow along channels 613 towards the ends of the strip.

The cores 615 provide the strip of the present embodiment with the necessary tensile strength to enable it to transmit forces along its length. Each core 615 comprises a sheath 616 which holds a bundle of filaments 618 which may be wires or polymer fibres. The latter are preferably used because they will not be corroded if water penetrates the sheath 616.

FIG. 13 illustrates a way of providing a connection to the stabilising strip 610 of FIG. 12. This is achieved by allowing parts of the cores 615 to project from one end of the strip where they are connected together to form a loop 617. This loop may be connected around a suitable device 620 attached to a facing element 622. As an alternative to connecting the two cores together, a continual core may be used which forms both cores 615 and the loop 617 without the need for a joint.

Figure 7:
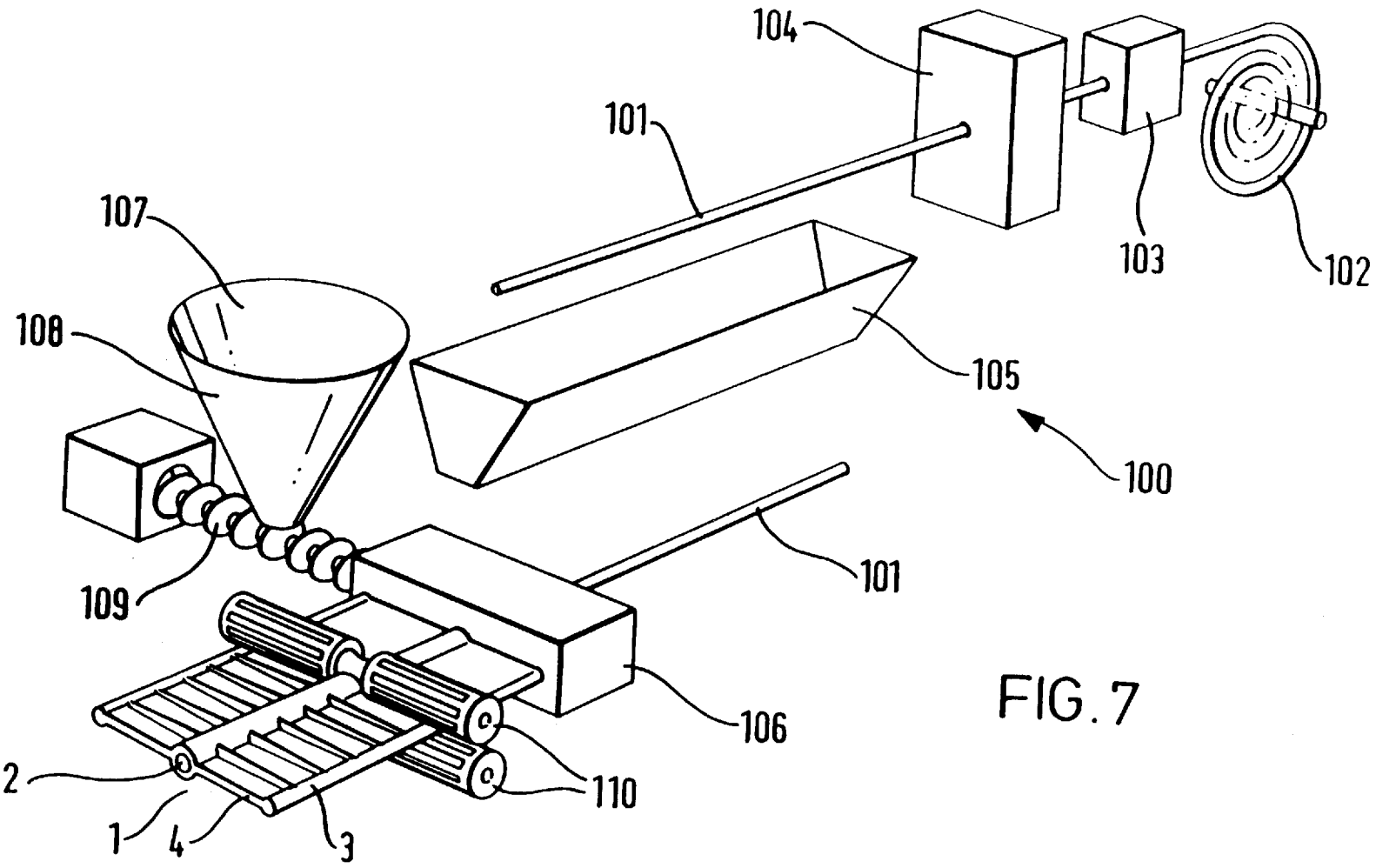
FIG. 7 is a perspective view of an apparatus for producing strips according to the invention, wherein material forming the lateral portion is moulded around the tensile portion.

FIG. 7 illustrates an apparatus 100 which is particularly suitable for producing strips of the first embodiment. A coil of reinforcing bar steel 102 is provided adjacent to a reinforcing bar straightener 103. The steel is fed from the coil through the straightener and then to a cutting machine 104 which is adjusted to cut the steel to lengths of bar 101 corresponding to the length of strip 1 which is required. The bars are then passed into a hopper 105 from which they may be fed to the remaining part of the apparatus.

Next, each bar 101 is fed from the bottom of the hopper 105 into a plastics extrusion dye 106. Into this dye is fed the raw plastics material 107 from a bin 108 in which it has been mixed with appropriate additives. The bin is heated and the molten plastic is fed by a screw pump 109 into the extrusion dye 106. The extrusion dye is provided with heater coils in order to maintain the plastics material in the molten state whilst it is moulded around the bar. The bar may be pushed or pulled through the dye and as it advances it is encased in the plastics material which forms the casing 3. After it leaves the dye 106 the bar, now coated with plastics, is hot rolled through a pair of rollers 110 which produce the ribs 5 on the wings 4 of the coated strip 1. If desired, the end of the strip may be sealed in order to protect the ends of the bar and then the plastics material is allowed to set thoroughly.

Figure 8:
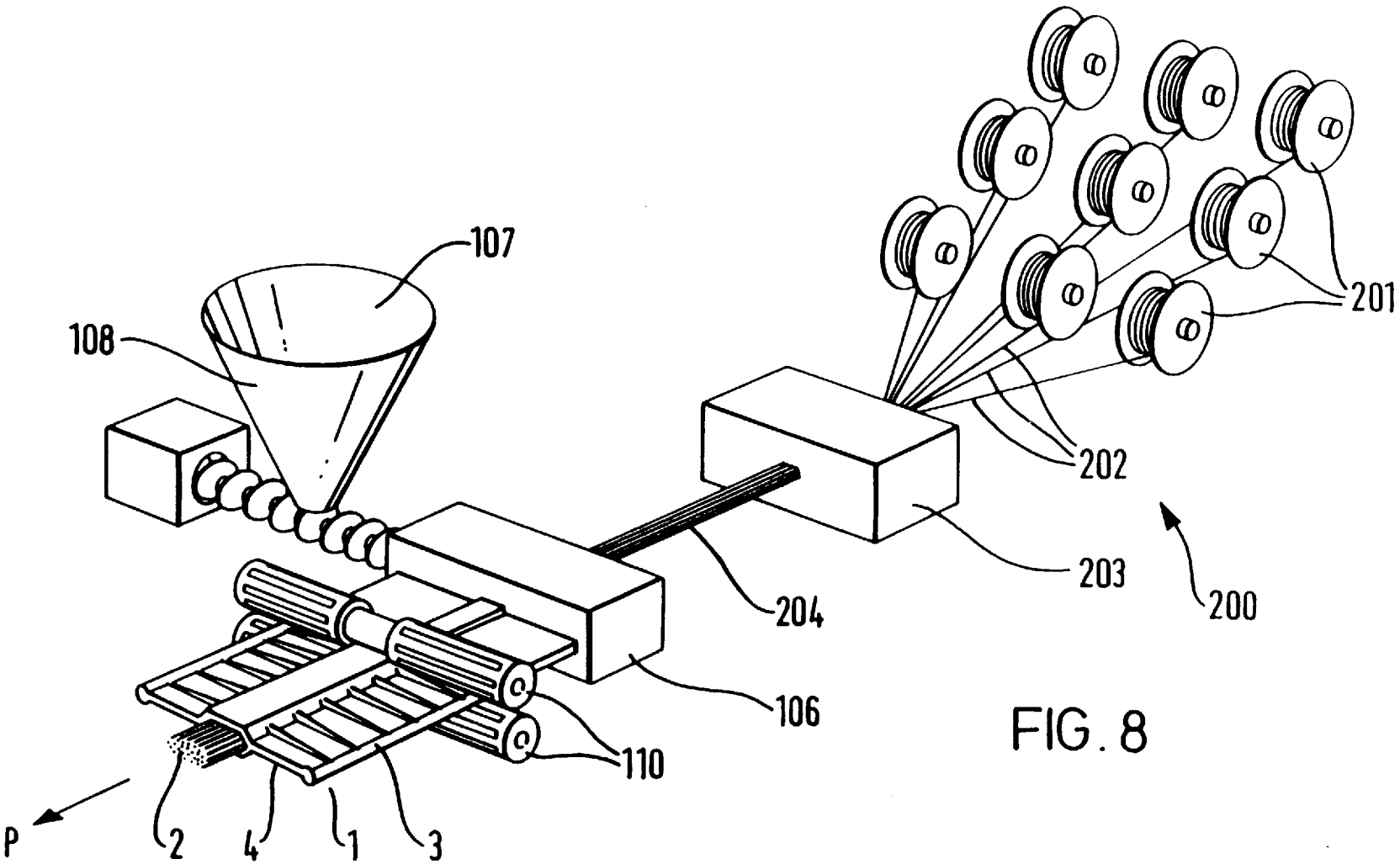
FIG. 8 is a perspective view of an alternative apparatus for producing strips according to the invention wherein the material forming the lateral portion is moulded around the tensile portion.

FIG. 8 illustrates an apparatus 200 which is generally similar to that of FIG. 7, except that it is adapted for producing strips of the second embodiment in which the tensile portion is a core of polymer yarns. The illustrated apparatus provides a continuous process in which the core is pulled in the direction of arrow P through the apparatus. The extrusion components are identical to those of FIG. 7. However, the reinforcing bar, coil straightener, cutting machine and hopper are replaced by a number of coils 201 of yarn 202 and a device 203 in which the yarns are brought together to form a single core 204. This core is then pulled through the extruding die 106 and rollers 110. The strip 1 once made could be wound onto a drum and cut to desired lengths on site, or, alternatively, cutting apparatus could be added after the extrusion apparatus. Depending on the type of core material, on the type of soil in which the strip is to be placed, and on the service life required for a structure to be erected using the strips, their ends may or may not be sealed when the strips are cut.

Figure 9:
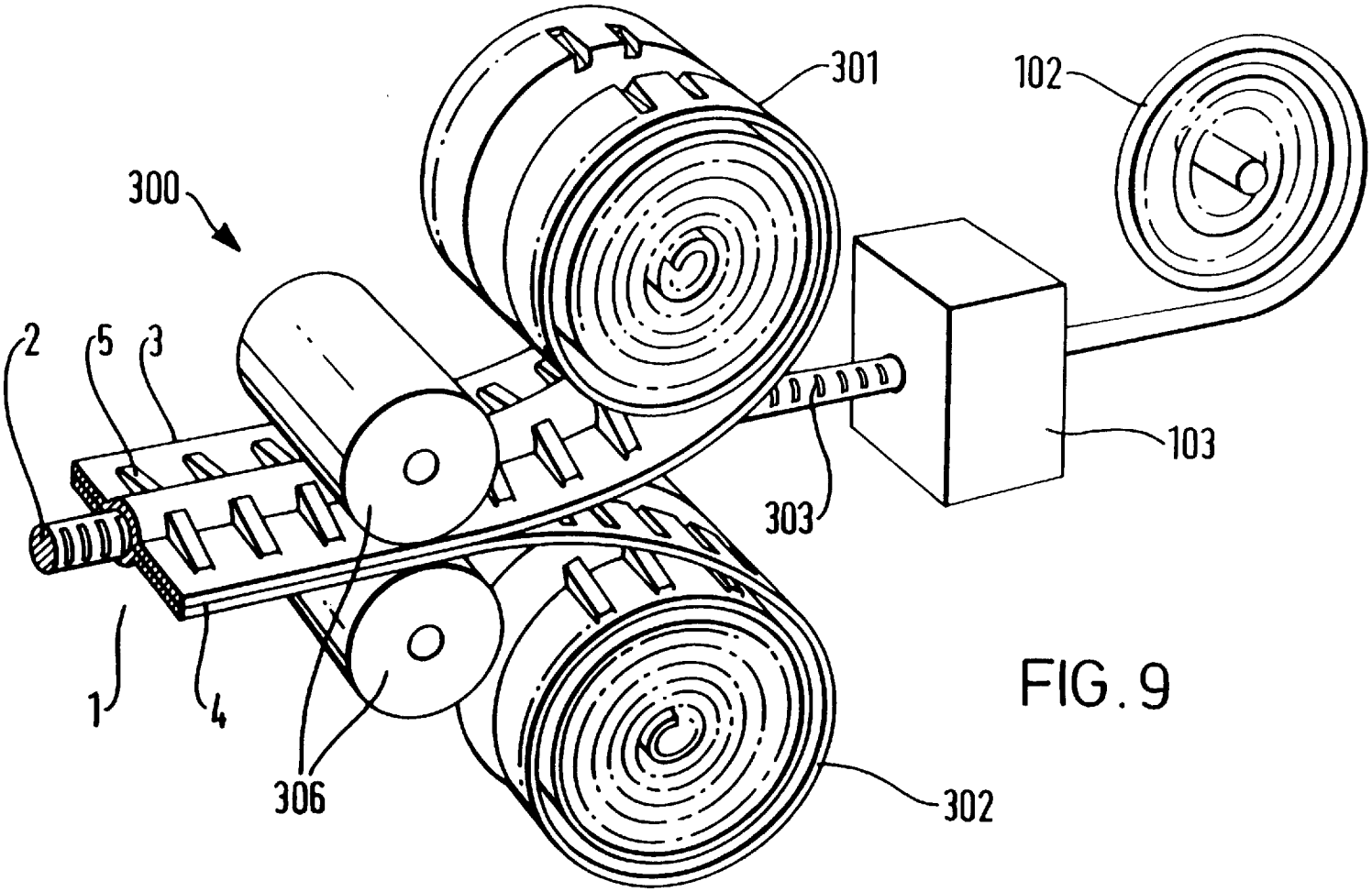
FIG. 9 is a perspective view of an apparatus for producing strips according to the invention wherein the tensile portion is sandwiched between the parts forming the lateral portion.

FIG. 9 illustrates an apparatus 300 for making strips of the first embodiment in which the casing 3 is formed (for example by extruding and rolling) in two separate parts 301,302 between which the core 2 is sandwiched. The core is fed from a coil of reinforcing bar material 102 through a reinforcing bar straightener 103 and then between coils containing the casing parts 301 and 302. One of these coils is located above the bar and the other directly beneath it, and as the core 2 is fed between them the material unrolls from the coils thereby sandwiching the core. A pair of press and weld cylinders 306 is provided downstream of the coils to seal the plastics material in position around the core. In an alternative arrangement, the coils may be located on each side of the bar, with the cylinders 306 having their axes arranged vertically. The apparatus may be arranged such that the action of pulling the core 2 will by itself unwind the parts 301,302 of the casing material from the coils. Further apparatus may be provided downstream of the press and weld cylinders 306 in order to cut strips of the required length. It will be appreciated that similar apparatus could be useful producing the strips of the second embodiment if yarn-handling apparatus of the type illustrated in FIG. 8 were used in place of the reinforcing bar coil 102 and reinforcing bar straightener 103.

Figure 10:
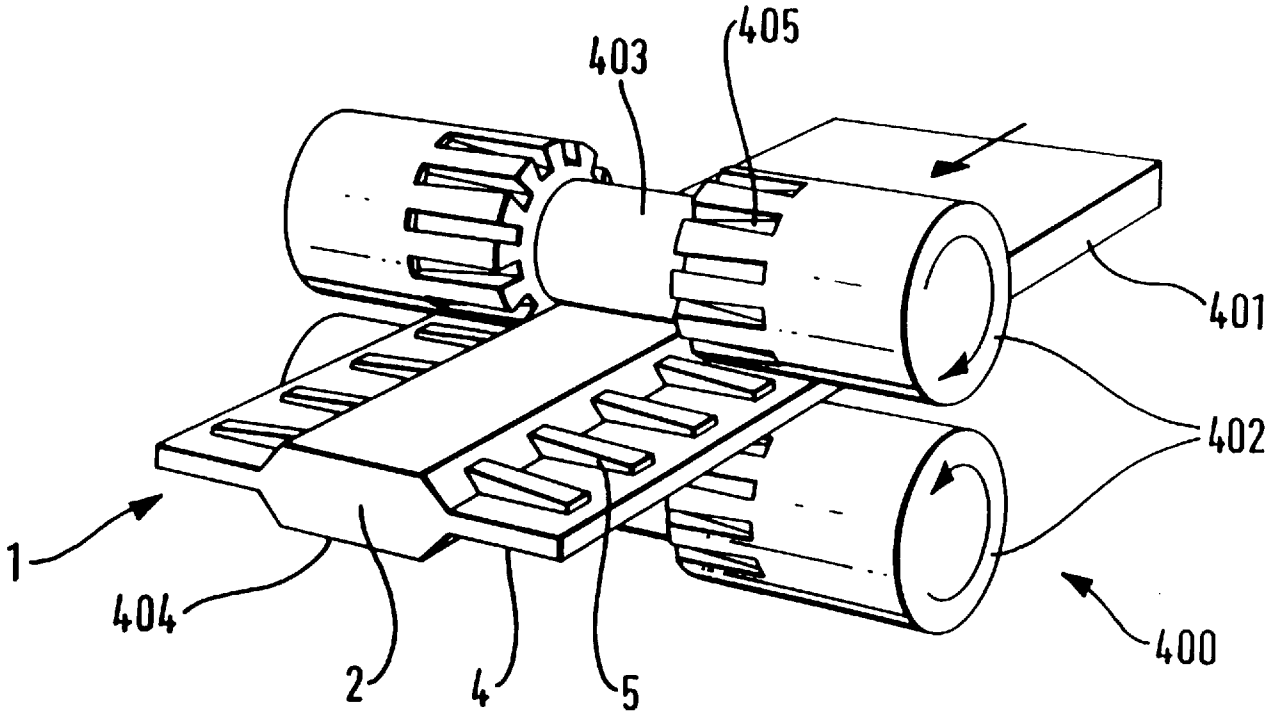
FIG. 10 is an apparatus for producing strips according to the invention using a pair of rollers.
Figure 11:
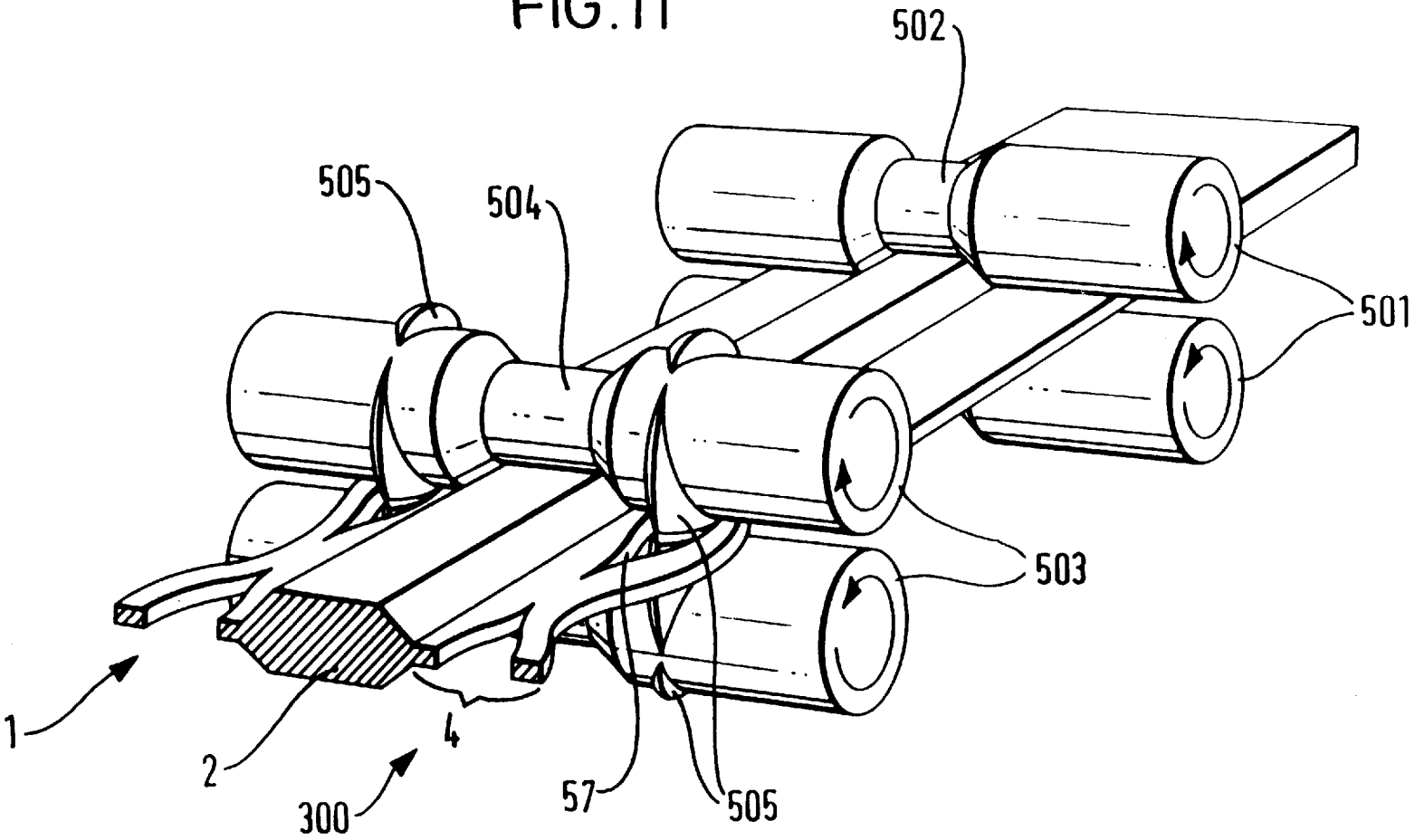
FIG. 11 is an apparatus for producing strips according to the invention using rollers and incorporating a perforating stage.

FIGS. 10 and 11 illustrate apparatus for rolling strips of, for example, steel in order to provide strips of the fourth and fifth embodiments respectively. FIG. 10 illustrates an apparatus 400 in which a strip of steel 401 passes through a pair of rollers 402. The rollers have a waist 403 which provides a raised, central portion 404 to the strip, thereby forming its core 2. On each side of the waist there are a series of indentations 405 which provide ribs 5 on the friction wings 4. The spacing of the rollers 402 determines the thickness of the wings.

In the apparatus 500 of FIG. 11 two pairs of rollers are provided. The first pair 501 serve to form the core 2 of the strip 1 and are provided with a waist portion 502 of an appropriate profile to achieve this. The rollers 501 are also spaced from each other by a distance which determines the thickness of the friction wings 4. After passing through the first rollers, the strip passes through a second pair of rollers 503 which as well as having a waist portion 504 to accommodate the core 2 of the strip are provided with pairs of cutters 505. It will be noted that these cutters are arranged to cut slits in the wings of the strip and also to open up the slits in a lateral direction as the strip passes between the rollers 503. In this way a series of apertures 57 is provided in the wings 4 and the lateral sides of the wings are provided with a series of projections and recesses.

If desired, the cutting pair of rollers 503 may be provided independently of the rollers 501, for example in another plant. In fact, such cutting rollers may be used directly on a conventional steel strip, i.e. one without a thickened core. In this case, the tensile portion of the strip comprises an uninterrupted longitudinal region, whilst the lateral portion for frictional engagement with the earth comprises a region of the same thickness but formed with apertures. The provision of the apertures increases the overall width of the strip for the amount of material used.

While preferred embodiments and methods have been set forth, the invention is to be limited only by the following claims and equivalents thereto.

We claim:

1. An elongate stabilizing strip for use in stabilized earth structures, comprising, in combination:

a longitudinal, tensile resistive core, and lateral projections extending laterally outwardly from opposite sides of the core for frictional engagement with earth said core and projections together defining the strip for stabilized earth structures.

2. The strip of claim 1, wherein the strip has opposite edges and the lateral projections extend to the edges and wherein the core has a thickness greater than the thickness of the lateral projections.

3. The strip of claim 1 wherein the lateral projections also extend in the longitudinal direction of the core.

4. The strip of claim 1 including a plurality of generally parallel longitudinal, tensile resistive cores, said cores connected together by horizontal, lateral projections.

5. The strip of claim 1 wherein the lateral projections include means for enhancing frictional interaction with the earth.

6. The strip of claim 1 wherein the lateral projections include friction enhancing means taken from the group consisting of ribs, corrugations, perforations and combinations thereof.

7. The strip of claim 1 further including an integral fastening member at one end for engagement with means for fastening the strip in a stabilized earth structure.

8. The strip of claim 1 wherein the core and projections are made from the same material.

9. The strip of claim 1 wherein the core and projections are unitary.

10. The strip of claim 1 wherein the core is made from a material having a greater tensile strength than the material of the projections.

11. The strip of claim 1 wherein the core is made from a steel material and the projections are made from a plastic material.

12. The strip of claim 1 wherein the core is made from polymer yarn or drawn bulk polymer and the projections are made from a plastic material.

13. The strip of claim 1 wherein the core is enclosed within the material forming the projections.

14. The strip of claim 1 including means for collection and transport of water longitudinally through the strip.

15. The strip of claim 1, in combination with particulate material, to form a stabilized earthen structure.

16. A method of manufacture of a reinforcing strip for use in stabilized earthen structure to frictionally engage earth, said strip having a longitudinal, tensile resistive core and horizontal, lateral projections extending laterally outwardly from opposite sides of the core, comprising the steps of providing a longitudinal core; and molding the lateral projections for frictional engagement with earth onto the core.

17. The method of claim 16 wherein the molding step is comprised of rolling a strip of material to form the lateral projections.

18. The method of claim 17 including the further step of forming apertures in the lateral projections.

19. The method of claim 16 including the step of providing a core of higher tensile strength material than tensile strength of the material of the lateral projections, and subsequently molding the lateral projections to surround the core.

20. The method of claim 16 wherein the molding step comprises forming the lateral projections by extrusion.

21. The method of claim 16 wherein the molding step comprises the step of forming first and second parts of the lateral projections and forming the core therebetween.

22. An elongate stabilizing strip for use in stabilized earth structures of the type including a facing wall, said strip comprising, in combination:

an elongate tensile portion having a wall attachment end and an opposite end;

means for attaching the wall attachment end to a wall; and lateral portions comprised of a material different than the tensile portion, said lateral portions attached to and extending laterally outwardly from the elongate tensile portion, said lateral portions positioned for frictional engagement with earth.

23. An elongate stabilizing strip for use in stabilized earth structure of the type including compacted earth having a plurality of strips positioned therein, said strip comprising, in combination:

an elongate tensile member comprised of a flexible core of a first material extending longitudinally; and horizontal, lateral projections of a second material attached to an extending laterally outwardly from the core for frictional engagement with compacted soil.

24. An elongate stabilizing strip for use in stabilized earth structures of the type including compacted earth having a plurality of strips positioned therein, said strip comprising, in combination:

an elongate tensile member comprised of a flexible core extending longitudinally; and horizontal, lateral projections separate from and attached to the tensile member, said projections extending laterally outwardly from the core and positioned for frictional engagement with compacted soil.

25. The strip of claims 1, 22, 23 or 24 in combination with compacted particulate material.

26. An elongate stabilizing strip for use in stabilized earth structures comprising, in combination:

a longitudinal, tensile resistive core;

lateral projections extending from opposite sides of the core for frictional engagement with earth; and means for collection and transport of water longitudinally through the strip.

27. A method of manufacture of a reinforcing strip for use in stabilized earthen structure to frictionally engage earth, said strip having a longitudinal, tensile resistive core and lateral projections from opposite sides of the core, comprising the steps of:

providing a longitudinal core;

molding the lateral projections for frictional engagement with earth onto the core; and forming apertures in the lateral projection.

28. An elongate stabilizing strip for use in stabilized earth structures comprising, in combination:

a longitudinal, tensile resistive core;

lateral projections extending from opposite sides of the core for frictional engagement with earth; and apertures in the lateral projections.

29. An elongate stabilizing strip for use in stabilized earth structures of the type including facing panels, said strip comprising, in combination:

a longitudinal, tensile resistive core structure; and lateral projections extending laterally outwardly from opposite sides of the core structure, said core structure forming a loop at one end for connection to a stabilized earth structure panel, said loop being generally in the same plane as the lateral projections.

30. An elongate stabilizing strip for use in stabilized earth structures of the type including facing panels, said strip comprising, in combination:

lateral projections of a second material attached to the core and extending laterally outwardly from at least one side of the core for frictional engagement with earth; and a connector attached to the core for attaching the strip to a panel.

31. An elongate stabilizing strip for use in stabilized earth structures of the type including facing panels, said strip comprising, in combination:

a longitudinal tensile resistive core;

lateral projections adhered to the core and extending laterally outwardly from the core for frictional engagement with earth, said lateral projections generally coplanar; and a connector for attaching the strip to facing panels, said connector attached at one end to the core and comprising a connection passage coplanar with the lateral projections.

32. An elongate stabilizing strip for use in stabilized earth structures comprising, in combination:

a longitudinal core; and lateral projections attached to the core and extending in opposite directions from opposite sides of the core to define a generally planar strip, said lateral projections including an outside edge section having a thickness greater than at least a portion of the thickness of the projections intermediate the core and the outside edge section.

33. An elongate stabilizing strip for use in stabilized earth structures comprising, in combination:

a longitudinal core; and lateral projections attached to the core and extending laterally from the core to define a wing, said wing including perforations therethrough for engagement of the wing with the earth.

34. An elongate stabilizing strip for use in stabilized earth structures comprising, in combination:

a longitudinal, tensile core; and lateral projections attached to the core and extending laterally from the core, said projections and core defining a generally planar strip, said projections further including outwardly extending ribs on the surface of the projections.

35. An elongate stabilizing strip for use in stabilized earth structures comprising, in combination:

a longitudinal tensile core; and lateral projections attached to the core and extending laterally from the core to define a generally planar strip, said projections including structural means for assisting frictional engagement of the projections with earth said structural means taken from the group consisting of openings, ribs, corrugations, indentations, slots, recesses, and combinations thereof.

* * * * *